US010765919B2

(12) United States Patent
Boggs et al.

(10) Patent No.: US 10,765,919 B2
(45) **Date of Patent: *Sep. 8, 2020**

(54) GOLF CLUB HEAD WITH MOLDED POLYMERIC BODY

(71) Applicant: Karsten Manufacturing Corporation, Phoenix, AZ (US)

(72) Inventors: Joshua Boggs, Aledo, TX (US); Eric Larson, Arlington, TX (US); Kevin Harper, Fort Worth, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/122,620

(22) Filed: Sep. 5, 2018

(65) Prior Publication Data

US 2018/0369660 A1 Dec. 27, 2018

Related U.S. Application Data

(63) Continuation of application No. 15/793,852, filed on Oct. 25, 2017, now Pat. No. 10,092,799, which is a continuation of application No. 14/724,328, filed on May 28, 2015, now Pat. No. 9,833,666.

(51) Int. Cl.
*A63B 53/04* (2015.01)
*A63B 60/52* (2015.01)

(52) U.S. Cl.
CPC ..... *A63B 53/0466* (2013.01); *A63B 60/52* (2015.10); *A63B 2053/045* (2013.01); *A63B 2053/0408* (2013.01); *A63B 2053/0433* (2013.01); *A63B 2053/0491* (2013.01); *A63B 2209/00* (2013.01)

(58) Field of Classification Search
CPC ..... A63B 2053/042
USPC ..... 473/335, 342, 337, 334
See application file for complete search history.

(56) References Cited

U.S. PATENT DOCUMENTS

| | | | | |
|---|---|---|---|---|
| 6,648,774 | B1 | 11/2003 | Lee | |
| 6,875,129 | B2 | 4/2005 | Erickson | |
| 6,971,961 | B2 | 12/2005 | Chen | |
| 8,992,339 | B2 | 3/2015 | Matsunaga | |
| 9,352,199 | B2 * | 5/2016 | Seluga | A63B 53/0466 |
| 9,403,071 | B2 * | 8/2016 | Sander | A63B 53/0466 |
| 2004/0033844 | A1 * | 2/2004 | Chen | A63B 53/0466 473/329 |

* cited by examiner

*Primary Examiner* — John E Simms, Jr.
*Assistant Examiner* — Rayshun K Peng

(57) ABSTRACT

A golf club head includes a forward section and a body section to define a closed internal volume. The forward section has a strike face, a frame that surrounds the strike face, and a flange extending from the frame. The body section is formed from a molded polymeric material, and includes a forward edge that defines a receiving portion adapted to receive the flange and a weight receiving feature spaced apart from the forward edge. The body section further includes a reinforcing structure protruding into the internal volume and extending between the weight receiving feature and the forward edge. The reinforcing structure is operative to transfer impact loads between the weight receiving feature and the metallic forward section.

20 Claims, 4 Drawing Sheets

GOLF CLUB HEAD WITH MOLDED POLYMERIC BODY

CROSS REFERENCE TO RELATED APPLICATIONS

This is a continuation of U.S. application Ser. No. 15/793,852, filed on Oct. 25, 2017, which is a continuation of U.S. application Ser. No. 14/724,328, filed on May 28, 2015, and issued as U.S. Pat. No. 9,833,666, which is hereby incorporated by reference in its entirety.

TECHNICAL FIELD

The present disclosure relates generally to a golf club head with a molded polymeric body.

BACKGROUND

A golf club may generally include a club head disposed on the end of an elongate shaft. During play, the club head may be swung into contact with a stationary ball located on the ground in an effort to project the ball in an intended direction and with a desired vertical trajectory.

Many design parameters must be considered when forming a golf club head. For example, the design must provide enough structural resilience to withstand repeated impact forces between the club and the ball, as well as between the club and the ground. The club head must conform to size requirements set by different rule setting associations, and the face of the club must not have a coefficient of restitution above a predefined maximum (measured according to applicable standards). Assuming that certain predefined design constraints are satisfied, a club head design for a particular loft can be quantified by the magnitude and location of the center of gravity, as well as the head's moment of inertia about the center of gravity and/or the shaft.

The club's moment of inertia relates to the club's resistance to rotation (particularly during an off-center hit), and is often perceived as the club's measure of "forgiveness." In typical club designs, high moments of inertia are desired to reduce the club's tendency to push or fade a ball. Achieving a high moment of inertia generally involves moving mass as close to the perimeter of the club as possible (to maximize the moment of inertia about the center of gravity), and as close to the toe as possible (to maximize the moment of inertia about the shaft). In iron-type golf club heads, this desire for increased moments of inertia have given rise to designs such as the cavity-back club head and the hollow club head.

While the moment of inertia affects the forgiveness of a club head, the location of the center of gravity behind the club face (and above the sole) generally affects the trajectory of a shot for a given face loft angle. A center of gravity that is positioned as far rearward (away from the face) and as low (close to the sole) as possible typically results in a ball flight that has a higher trajectory than a club head with a center of gravity placed more forward and/or higher.

While a high moment of inertia is obtained by increasing the perimeter weighting of the club head or by moving mass toward the toe, an increase in the total mass/swing weight of the club head (i.e., the magnitude of the center of gravity) has a strong, negative effect on club head speed and hitting distance. Said another way, to maximize club head speed (and hitting distance), a lower total mass is desired; however a lower total mass generally reduces the club head's moment of inertia (and forgiveness).

In the tension between swing speed (mass) and forgiveness (moment of inertia), it may be desirable to place varying amounts of mass in specific locations throughout the club head to tailor a club's performance to a particular golfer or ability level. In this manner, the total club head mass may generally be categorized into two categories: structural mass and discretionary mass.

Structural mass generally refers to the mass of the materials that are required to provide the club head with the structural resilience needed to withstand repeated impacts. Structural mass is highly design-dependent, and provides a designer with a relatively low amount of control over specific mass distribution. On the other hand, discretionary mass is any additional mass that may be added to the club head design for the sole purpose of customizing the performance and/or forgiveness of the club. In an ideal club design, the amount of structural mass would be minimized (without sacrificing resiliency) to provide a designer with a greater ability to customize club performance, while maintaining a traditional or desired swing weight.

SUMMARY

A golf club head includes a forward section and a body section. The forward section has a strike face, a frame that surrounds the strike face, and a flange extending from the frame. The body section is formed from a molded polymeric material, and includes a forward edge that defines a receiving portion adapted to receive the flange and a weight receiving feature spaced apart from the forward edge. The body section further includes a reinforcing structure protruding into the internal volume and extending between the weight receiving feature and the forward edge. The reinforcing structure is operative to transfer impact loads between the weight receiving feature and the metallic forward section, for example, during an impact between the strike face and a golf ball. In one configuration, the forward edge of the body section may be separated from the strike face by a distance of from about 15 mm to about 40 mm.

In one configuration, the flange is orthogonal to a reference plane, and has a width, measured orthogonally to the reference plane, of from about 3 mm to about 2 mm. Additionally, the flange may be adhered to the body section across a total surface area of from about 1300 $mm^2$ to about 3000 $mm^2$. The flange may further fully encircle an internal volume that is at least partially defined by the forward section and the body section.

The body section may be formed from a multi-component construction and may include a first polymeric portion and a second polymeric portion that are adhered together at a body seam to define an internal cavity. The first polymeric portion may include a body flange disposed along a portion of the body seam, and the second polymeric portion may include a second receiving portion adapted to receive the body flange. In this embodiment, when assembled, the body flange extends within the second receiving portion and is adhered to the second polymeric portion. In one configuration, the height of the body flange decreases as a function of an increasing distance from the forward edge.

The above features and advantages and other features and advantages of the present technology are readily apparent from the following detailed description when taken in connection with the accompanying drawings.

DETAILED DESCRIPTION

Figure 1:
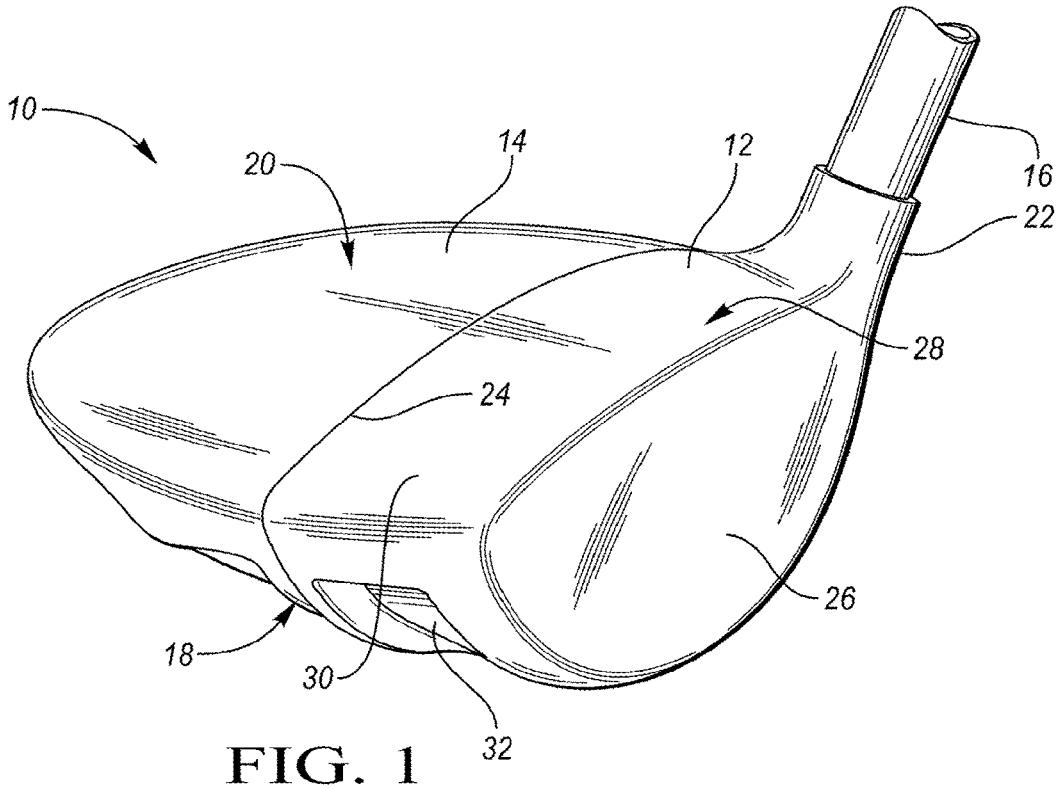
FIG. 1 is a schematic perspective view of a golf club.

Referring to the drawings, wherein like reference numerals are used to identify like or identical components in the various views, FIG. 1 schematically illustrates a wood-type golf club head 10 that includes a forward section 12 and a body section 14. The club head 10 may be mounted on the end of an elongate shaft 16, which may be gripped and swung by a user to impart a generally arcuate motion to the club head 10.

When the club head 10 is held in a neutral hitting position (i.e., where the shaft 16 is maintained entirely in a vertical plane and at a prescribed lie angle relative to a horizontal ground plane) the club head 10 may generally include a lower portion (i.e., a "sole 18"), an upper portion (i.e., a "crown 20"), and a hosel 22. For the purpose of this description, the crown 20 may meet the sole 18 where the surface has a vertical tangent (i.e., relative to the horizontal ground plane). The hosel 22 generally extends from the crown 20 and is configured to receive a shaft adapter or otherwise couple with the elongate shaft 16.

Figure 2:
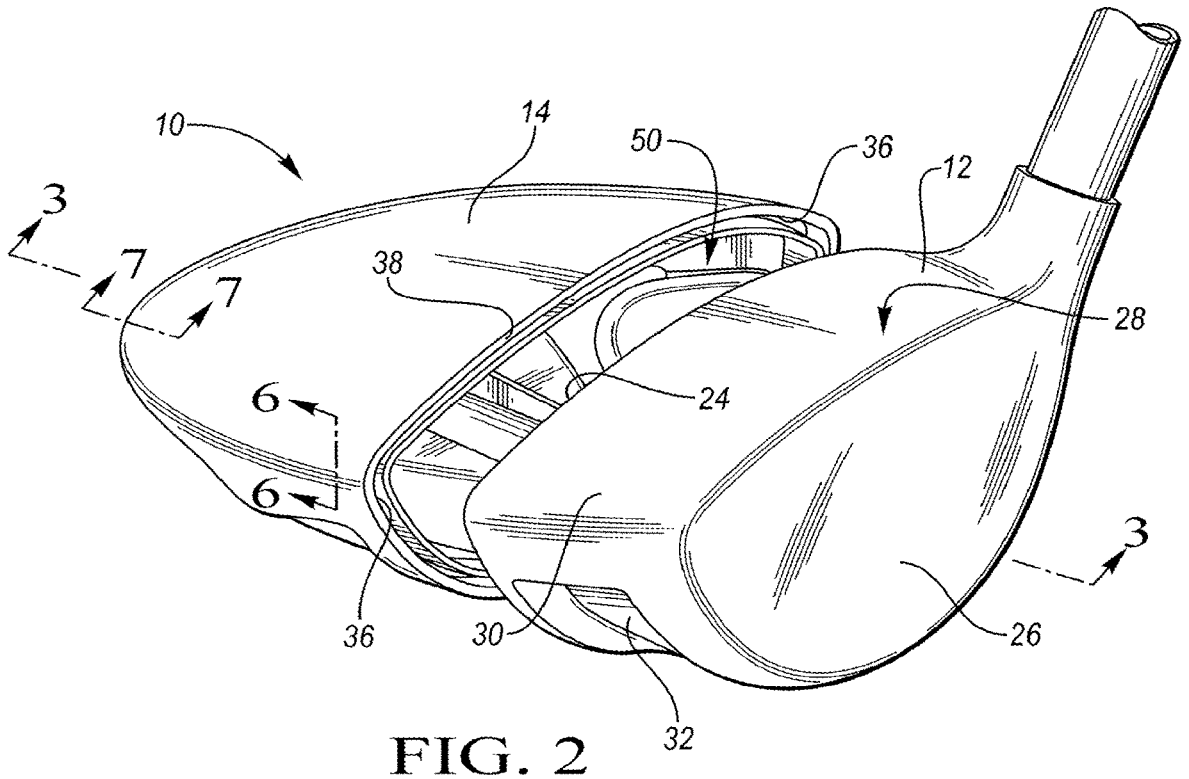
FIG. 2 is a schematic exploded perspective view of the golf club head of FIG. 1.

As generally illustrated in FIGS. 1-2, the forward section 12 and body section 14 are distinct components that are coupled at a seam/interface 24. The forward section 12 of the club head 10 includes a strike face 26 that is intended to impact a golf ball during a normal swing, and a frame 28 that surrounds the strike face 26 and includes the hosel 22. Because an impact with a ball can generate considerably large stresses near the point of impact and the hosel 22, the forward section 12 may be formed from one or more metallic materials that are suitable to withstand any expected impact loading. Examples of suitable materials may include, but are not limited to, various alloys of stainless steel or titanium.

The strike face 26 generally forms the leading surface of the club head 10 and has a slight convex/arcuate curvature that extends out from the club head 10. In one embodiment, the curvature (i.e., bulge and/or roll) of the strike face 26 has a radius of from about 7 inches to about 20 inches. Additionally, as is commonly understood, the strike face 26 may be disposed at an angle to a vertical plane when the club is held in a neutral hitting position. This angle may be generally referred to as the loft angle or slope of the club. Wood-type club heads (including hybrid woods), such as illustrated in FIG. 1, may most commonly have a loft angle of from about 8.5 degrees to about 24 degrees, though other loft angles are possible and have been commercially sold.

In one configuration, the frame 28 may include a swept-back sidewall portion 30 that extends away from the strike face 26. The sidewall portion 30 may form a portion of both the sole 18 and the crown 20, and may further include one or more surface profile features, such as an indented compression channel 32. The frame 28 may be rigidly attached to the strike face 26 either through integral manufacturing techniques, or through separate processes such as welding, brazing, or adhering.

In one configuration, to reduce the structural mass of the club head 10 beyond what is capable with traditional metal forming techniques, the body section 14 may be formed from a polymeric material and may be adhered to the forward section 12. The comparatively low density nature of polymeric materials also permits greater design flexibility, at less of a structural weight penalty, than similar designs made from metal. In one configuration, the desired design flexibility may be achieved by molding the polymeric material into shape using a molding technique, such as, injection molding, compression molding, blow molding, thermoforming or the like. To provide the maximum design flexibility, the preferred molding technique is injection molding.

While weight savings and design flexibility are important, the polymeric material must still be strong enough to withstand the stress that is experienced when the club head 10 impacts a ball. This may be accomplished through a combination of structural and material design choices. With regard to material selection, it is preferable to use a moldable polymeric material that has a tensile strength of greater than about 200 MPa (according to ASTM D638), or more preferably greater than about 250 MPa. Additionally, for ease of molding, if the polymeric material is filled, then the material should desirably have a resin content of greater than about 50%, or even greater than about 55% by weight. One such material may include, for example, a thermoplastic aliphatic or semi-aromatic polyamide that is filled with chopped fiber, such as chopped carbon fiber or chopped glass fiber. Other materials may include polyimides, polyamide-imides, polyetheretherketones (PEEK), polycarbonates, engineering polyurethanes, and/or other similar materials.

In general, while polymers may provide weight saving advantages, certain polymers, such as polyamides, may be difficult to reliably adhere due to their low surface energies. This may present a problem, for example, when attempting to secure the body section 14 to the forward section 12. The present design addresses this adhesion problem through the design of the interface/seam 24 between the forward section 12 and the body section 14. More specifically, the interface 24 incorporates a tongue-in-groove-style geometry to maximize contact area with the adhesive. By forming the interface 24 in this manner, the bond surface area is effectively doubled (i.e., opposing sides of a single flange), and the majority of the bond would experience predominantly sheer stress if removal were attempted (which has proven to provide a stronger bond than comparable joints relying on peel/tensile strength).

Figure 3:
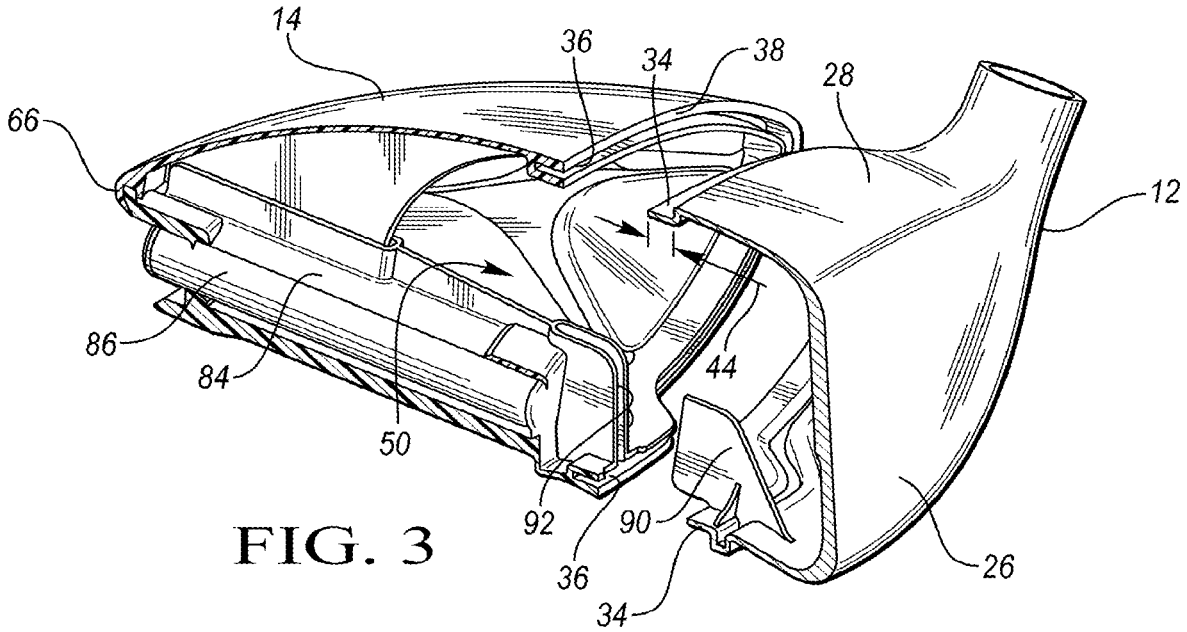
FIG. 3 is a schematic cross-sectional side view of the golf club head of FIG. 2, taken along line 3-3.

As shown in FIG. 3, the forward section 12 includes a flange 34 that extends from the frame 28 and is configured to be inserted into a mating receiving portion 36 of the body section 14. When assembled, the flange 34 extends within the channel such that the receiving portion 36 extends to opposing sides of the flange 34. Once in position, the flange 34 may be secured in place using, for example, a suitable adhesive or other fastening means. Suitable adhesives may include, for example, two-part acrylic epoxies or high viscosity cyanoacrylate adhesives. This design may emphasize sheer bond strength by physically permitting removal of the flange 34 only along a direction that is substantially parallel to the majority of the bond area (i.e., where the bond area is within 45 degrees of parallel to the direction of removal).

Figure 4:
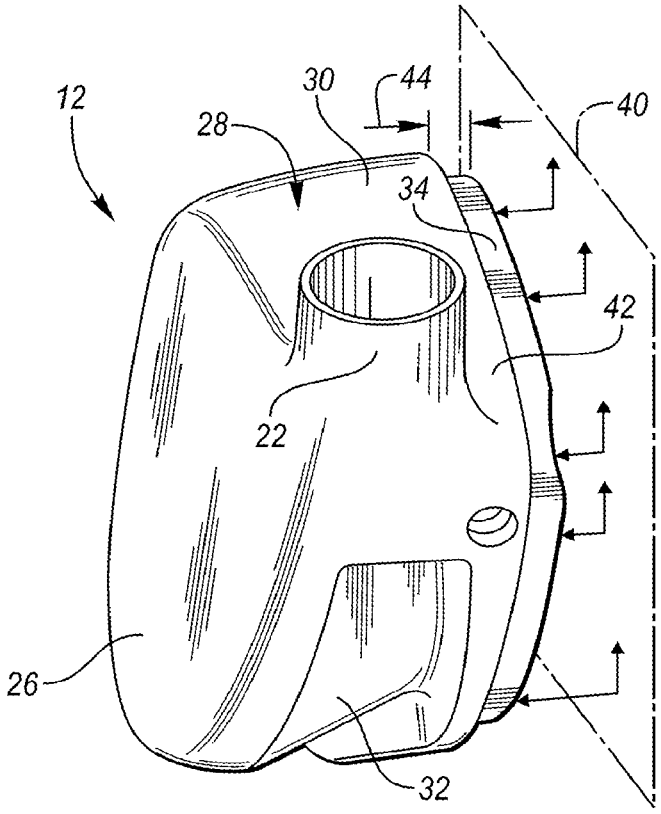
FIG. 4 is a schematic perspective view of the forward section of a golf club head aligned with a reference plane.

In one configuration, the receiving portion may be defined by a forward edge 38 of the body section 14, and may resemble a continuous channel or groove. To promote easy assembly, the flange 34 is preferably oriented such that it is orthogonal to a reference plane 40, as shown in FIG. 4, or such that it may be inserted into the receiving portion along a single direction of motion and without the need to reorient either the forward section 12 or the body section 14. In one configuration, the orientation of the flange 34 may be irrespective of the distance between the flange 34 and the plane 40, and likewise need not be parallel to the immediately proximate outer surface 42 of the forward section 12. For example, as shown in FIG. 4, due to the geometry of the forward section 12 certain portions of the flange 34 may be closer to the plane 40 than others. Additionally, as shown in FIG. 3, while the flange 34 may generally extend around the outer perimeter of the club head 10, in some embodiments, the flange 34 may be recessed below an outer surface 42 of the frame 28 to enable the receiving portion 36 to extend to both sides of the flange 34 while maintaining a smooth outer profile of the club head 10. In this manner, the flange 34 may be independently oriented and positioned from the outer surface 42. For example, in one configuration, the flange 34 may be separated from the outer surface by a normal, recessed distance that can vary within the range of from about 2 mm to about 10 mm, depending on the flange and body geometry.

In another embodiment, instead of the flange 34 being strictly orthogonal to the reference plane 40, the flange 34 may be pitched inwards by up to, for example, about 10 degrees. This pitch may be a fixed pitch, or may be variable such that the flange 34 is parallel to the body section 14 when inserted into the receiving portion 36. In this specific embodiment, the receiving portion may be, for example a channel that is dimensioned to accept the pitched flange, or may only be a single-sided receiving portion (e.g., similar to a lap joint) rather than a channel.

In one embodiment of the present design, an acceptable bond strength between the forward section 12 and the body section 14 may be achieved using a flange 34 that has a width 44, measured orthogonally to the reference plane 40, of from about 2 mm to about 8 mm (as shown in FIG. 3), or even from about 3 mm to about 5 mm. Likewise, acceptable bond strength may be achieved by adhering the flange 34 to the body section 14 across a total surface area of from about 1300 $mm^2$ to about 3000 $mm^2$, or from about 2000 $mm^2$ to about 2800 $mm^2$, where at least a majority of the bond area prevents removal via sheer (i.e., where the bond surface is within 45 degrees of parallel to the direction of removal). Additionally, in one configuration, the flange 34 fully encircles an internal volume 50 defined by the forward section 12 and the body section 14.

As noted above, the highest stress concentrations during a club head impact are generally found near the strike face 26. To ensure that the polymeric body section 14 does not experience stress loads that exceed its design strength, the forward edge 38 of the body section 14 may be separated from the strike face 26 by a distance of from about 15 mm to about 40 mm when assembled. Said another way, the sidewall 30 of the forward section 12 may extend from the strike face 26 by a distance of from about 15 mm to about 40 mm. This distance may be sufficient to allow localized impact stresses to dissipate to a level that can be withstood by the polymer.

In one configuration, the body section 14 may be entirely molded through a single process. If complex geometries are desired, molding techniques such as lost core molding or injection molding with collapsible slides may be used to form any internal recesses or cavities. In another configuration, instead of a unitary design, the body section 14 may be formed as two or more portions that are subsequently joined together (i.e., shown in FIG. 5). Such a multi-piece design may reduce the complexity of the molding process, but may add additional manufacturing steps to fuse the components together.

Figure 5:
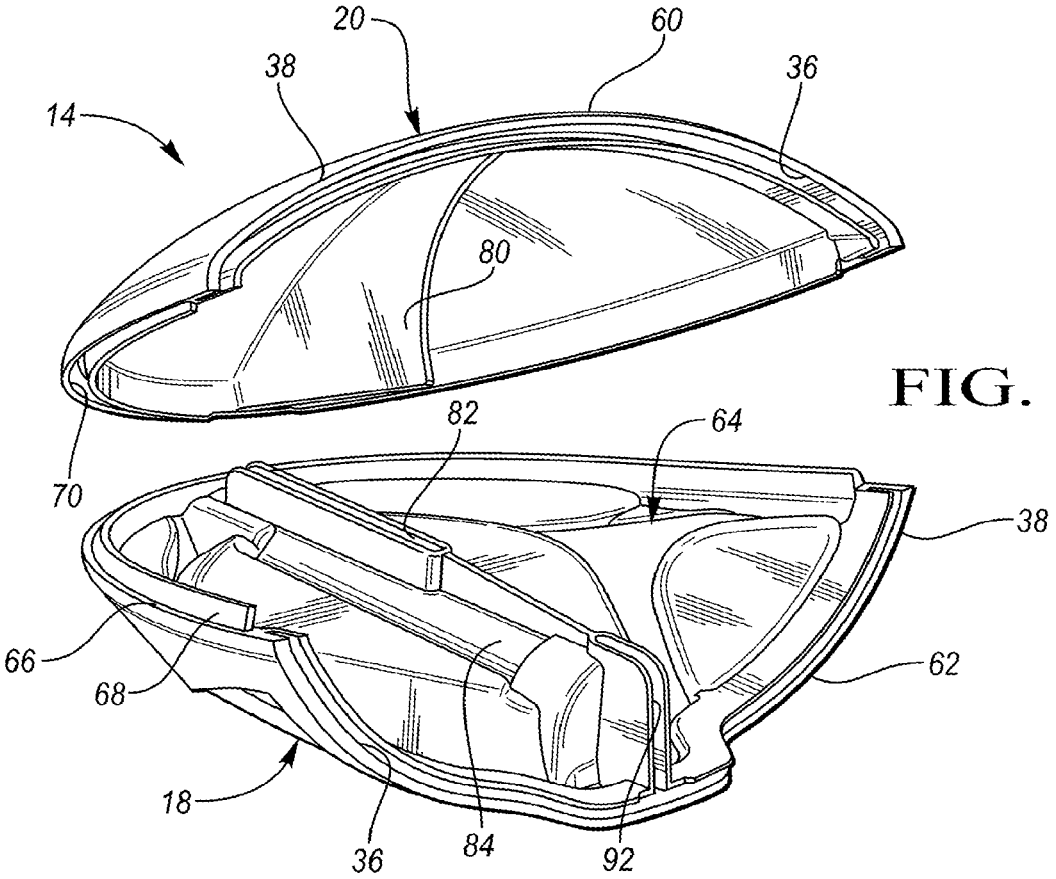
FIG. 5 is a schematic exploded view of the body section of the golf club head provided in FIG. 2.

With continued reference to FIG. 5, in one configuration the multi-piece construction may include a first, upper portion 60 and a second, lower portion 62 that may be joined together in a clamshell-style arrangement to define an internal cavity 64. In the illustrated design, the upper portion 60 may form a portion of the crown 20 and the lower portion 62 may form a portion of the sole 18. The two portions 60, 62 may meet at a body seam 66 that extends around a perimeter of the body section 14, such as within about 10 mm of the interface between the sole 18 and the crown 20. In one configuration, the body seam 66 may approximately divide the body section 14 in half, and/or may meet the forward edge 38 at an angle of from about 80 degrees to about 100 degrees. While FIG. 5 illustrates a body design that includes two portions/components, other designs may include three or more components.

The various portions of the body section 14 may be affixed together using any suitable means, such as, for example, welding or gluing. Suitable welding methods may include stir welding, ultrasonic welding, or laser welding. If adhesive is used, the design of the joint may employ a similar tongue-in-groove-style joint as between the forward section 12 and the body section 14. Such a design promotes proper alignment, while also maximizing total bond surface area, and maximizing bond surface area that resists removal via sheer strength. In the embodiment shown in FIG. 5, the lower portion 62 includes a body flange 68 that is disposed along a portion of the body seam 66 and is configured to extend within a mating receiving portion 70 of the upper portion 60.

Figure 6:
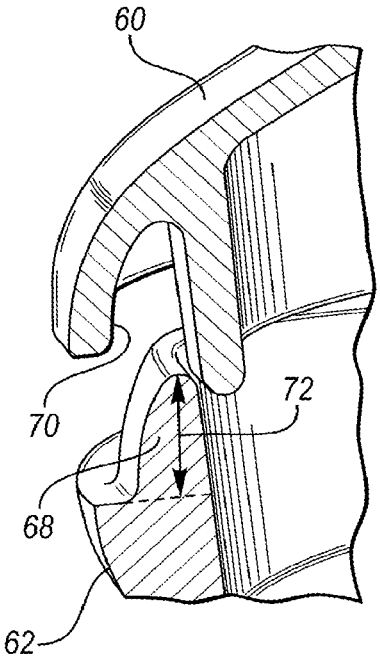
FIG. 6 is a schematic partial cross-sectional side view of the golf club head of FIG. 2, taken along line 6-6.
Figure 7:
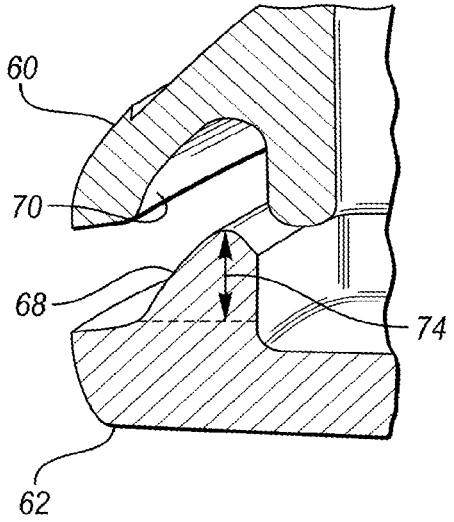
FIG. 7 is a schematic partial cross-sectional side view of the golf club head of FIG. 2, taken along line 7-7.

FIGS. 6 and 7 provide cross-sectional views of the body seam 66 to more clearly illustrate the body flange 68 and receiving portion 70. FIG. 6 is taken from a location that is more proximate to the forward edge 38 than FIG. 7. As shown from these two figures, in one configuration, the geometry and/or height of the body flange 68 may change as a function of the distance from the forward edge 38. The variable geometry and/or decreasing height is meant to accommodate the contours of the body section 14, and specifically where the body section 14 takes a thinner vertical profile as it extends further from the strike face 26.

At the most forward portion (i.e., closest to the forward edge 38 of the body section 14), such as shown in FIG. 6, the body flange 68 may have a maximum height 72 of from about 3.0 mm to about 5.0 mm or from about 3.5 mm to about 4.5 mm. Likewise, at the furthest position from the forward edge 38, the body flange 68 may have a height 74 of from about 1.0 mm to about 4.0 mm or from about 1.5 mm to about 3.0 mm, where the height 74 is less than the height 72 at the most forward portion.

Referring again to FIG. 5, the body section may further include a support flange 80 that extends within the internal cavity 64 between the crown 20 and the sole 18. The support flange 80 may serve as a reinforcing strut that is operative to stiffen the club head 10 (e.g., increase one or more modal frequencies) or to allow one or both of the crown 20 and the sole 18 to be made thinner/lighter while still maintaining at least a desired minimum stiffness. The support flange 80 may either directly extend out from the body seam 66 into the internal cavity 64, or, may more generally lie in a plane that intersects the body seam 66. In one configuration, the plane may intersect the body seam 66 at an angle of from about 80 degrees to about 100 degrees.

In the design provided in FIG. 5, the flange 80 may extend from the upper portion 60 of the body section 14, and may be secured or adhered to the lower portion 62. Similar to the two joints already described, the support flange 80 may be secured/adhered using a tongue-in-groove-style joint that maximizes bond surface area and prevents removal primarily via sheer strength. More specifically, during assembly, the support flange 80 may be inserted and adhered within a corresponding receiving portion 82 provided in the opposing portion of the body section 14 (e.g., the lower body portion 62 as shown in FIG. 5). The receiving portion 82 may be a channel that is formed between two uniformly spaced walls/protruding ridges that are positioned such that they extend on opposing sides of the flange 80 when the body section 14 is assembled. FIG. 3 illustrates the support flange 80 of FIG. 5 secured in place.

In one embodiment, one or more removable weight members may be selectively secured to the body section 14 for the purpose of modifying the center of gravity or moment of inertia of the club head 10. These removable weight members may alter the dynamics of the club head 10 throughout the swing and at impact, and provide a user with a desirable amount of post-purchase customization.

From a structural perspective, however, the inclusion of variably sized, localized masses can potentially impart large structural stresses throughout the swing in the proximity of the mass. To account for these stresses, in one configuration, one or more support flanges 80 may be positioned in a manner to buttress a localized mass (or weight-receiving feature configured to receive and retain the mass).

FIG. 3 illustrates an embodiment where the body section 14 includes a weight receiving feature 84 (i.e., a tubular opening) that is configured to selectively receive and retain an elongate weight member 86. The elongate weight member 86 may be, for example, an unbalanced elongate object that is capable of being inserted and selectively secured within the tubular opening in one of two orientations. The weight member 86 may have a total mass of, for example, from about 10 g to about 20 g, and reversing the weight member 86 may be operative to move the center of gravity of the club head 10 by a distance of greater than about 2.0 mm. Additional detail about potential embodiments of the weight receiving portion 84 and weight member 86 may be found in U.S. patent application Ser. No. 14/493,495, entitled "Golf Club With Removable Weight," which is incorporated by reference in its entirety.

In one configuration, such as shown in FIG. 3, the support flange 80 may be aligned with the weight receiving feature 84 and used to buttress any additional loads or moments that may be attributable to the increased mass of the elongate weight member 86. In this embodiment, the support flange 80 may be oriented such that it is parallel to a longitudinal axis of the weight tube, and such that it extends between the weight tube and the upper portion 60 of the body section 14. Said another way, the support flange 80 directly couples the weight tube with the crown 20.

Other examples of weight receiving features 84 may include, for example, threaded openings, slider tracks, or cam-lock mechanisms that are adapted to receive at least a portion of the weighting member 86. Similarly, other examples of weighting members 86 may include masses that are adapted to, for example, screw into the receiving feature 84, lock into the receiving portion 84 (e.g., via a set screw or cam-lock mechanism), or be secured within the receiving portion using a threaded cap.

To further buttress the weight receiving feature 84, for example, if the weight receiving feature 84 is cantilevered into the internal volume 50, the body section 14 may include a reinforcing structure protruding into the internal volume 50 and extending between the weight receiving feature 84 and the forward edge 38. As shown, for example, in FIGS. 3, 5, and 8, this reinforcing structure may include one or more walls, gussets, ridges, and/or protrusions that may serve a load transfer/buttressing function. As further shown, the forward section 12 may include an additional support flange 90 that couples with this reinforcing structure. The support flange 90 may function similar to the support flange 80, but may be primarily used to reinforce cantilevered body structure, such as the weight receiving feature 84 in a fore-aft direction (i.e., a direction through the strike face 26), particularly during an impact between the strike face and a golf ball.

The support flange 90 may extend from the sidewall 30 or frame 28 and may generally intersect the flange 34 at an angle of, for example, from about 80 degrees to about 100 degrees. Similar to the joints already described above, the support flange 90 may be secured/adhered to the body section 14 using a tongue-in-groove-style joint that maximizes bond surface area and prevents removal primarily via sheer strength.

Figure 8:
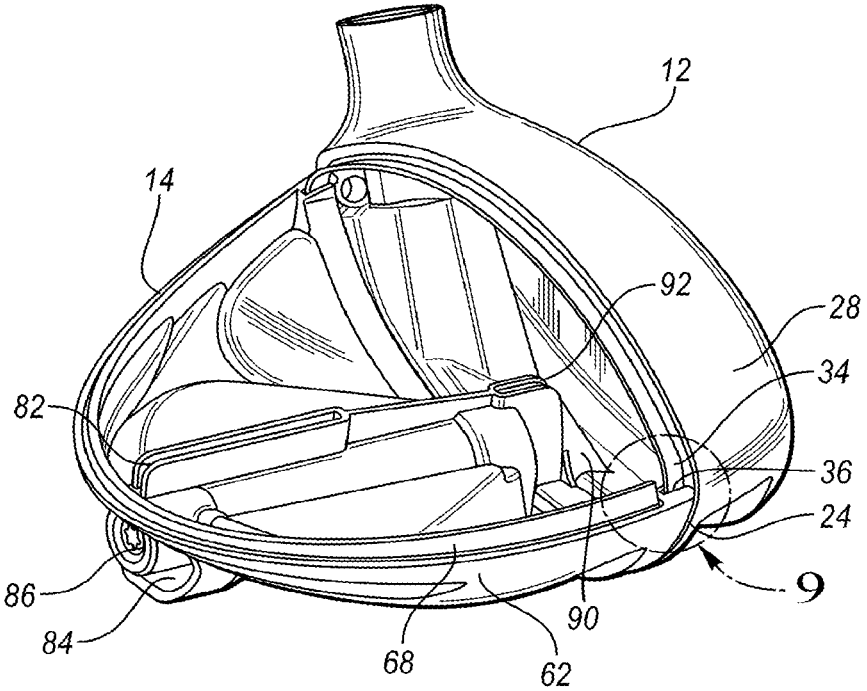
FIG. 8 is a schematic perspective view of a lower portion of a body section of a golf club head affixed to a forward section of the golf club head.

More specifically, during assembly, the support flange 90 may be inserted and adhered within a corresponding receiving portion 92 formed by the reinforcing structure buttressing the weight receiving portion 84 of the body section 14. The receiving portion 92 may be a channel that is formed between two uniformly spaced walls/protruding ridges that are positioned to extend on opposing sides of the flange 90 when the forward section 12 is joined with the body section 14. In the illustrated embodiment, the support flange 90 and receiving portion 92 may be aligned such that the support flange 90 is operative to support the weight receiving feature 84 along the longitudinal axis of the weight tube, for example, during an impact with a golf ball. FIG. 8 illustrates the support flange 80 of FIG. 3 secured in place.

Figure 9:
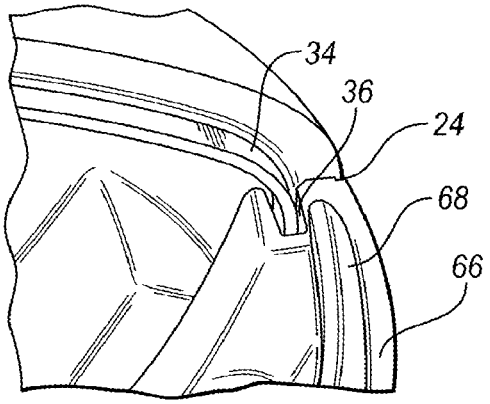
FIG. 9 is a schematic enlarged perspective view of the area marked "FIG. 9" provided in FIG. 8.

FIG. 9 more clearly illustrates the tongue-in-groove-style joint between the forward section 12 and the body section 14. As shown, the flange 34 extends entirely into the receiving portion 36 until the forward edge 38 of the body section 14 contacts the forward section 12. In this embodiment, adhesive may be applied within the channel/receiving portion 36, and may extend to both sides of the flange.

While the present disclosure describes certain specific arrangements for the tongue-in-groove-style joints, these are meant for illustrative purposes only. For example, it would be equally possible for the body flange 68 to extend from the upper portion 60 of the body section 14 into a receiving portion 70 provided in the lower portion 62. Likewise, the support flange 80 may extend from the lower portion (and specifically from the weight receiving feature 84) and be adhered into a corresponding receiving portion 82/channel provided in the upper portion 60.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The invention claimed is:

1. A golf club head comprising:

a forward section joined to a body section via a tongue-in-grove joint to define an internal volume therebetween;

the body section includes:

a lower portion that defines a sole portion and further comprises a body seam and a body flange;

an upper portion that defines a crown portion and further comprises a first receiving portion configured to mate with the body flange of the lower portion in a clamshell-style arrangement;

a second receiving portion defined by a forward edge and is positioned proximal to the forward section and extends circumferentially around the upper portion and the lower portion of the body section in a direction extending substantially parallel to a strike face;

a support flange extending from the upper portion of the body section and secured to a support flange receiving portion;

the forward section includes:

the strike face adapted to impact a golf ball;

a frame member extending rearwardly from the strike face and a forward flange further extending rearwardly from the frame member;

wherein:

the lower portion and the upper portion of the body section are distinct, single piece structure, thereby defining a first part and a second part, respectively;

the forward section and the body section cooperate to form a three-part golf club head;

the body seam extends around a perimeter of the lower portion and wherein the body flange is disposed along the body seam;

wherein a height of the body flange decreases as a function of an increasing distance from the forward edge;

the first receiving portion of the upper portion is adapted to engage the body flange of the lower portion to become adhesively affixed;

the forward flange of the forward section is configured to be directly inserted into the second receiving portion to become adhesively affixed;

the support flange of the body section increases stiffness of the clubhead;

the support flange receiving portion forms a channel that is defined by two uniformly spaced walls positioned such that the two uniformly spaced walls extend on opposing sides of the support flange; and the support flange receiving portion is positioned on the lower portion of the body section.

2. The golf club head of claim 1, wherein the forward section is a metallic material.

3. The golf club head of claim 2, wherein the body section is a polymeric material.

4. The golf club head of claim 3, wherein the polymeric material of the body section has a lighter density than the metallic material of the forward section.

5. The golf club head of claim 1, wherein the forward flange can be pitched inwardly up to 10 degrees.

6. The golf club head of claim 1, wherein the forward flange is strictly orthogonal to a reference plane.

7. The golf club head of claim 1, wherein a weight receiving feature is adapted to receive a removable weight member and extends in a direction perpendicular to the strike face.

8. The golf club head of claim 7, wherein one or more removable weight members are in the weight receiving feature.

9. The golf club head of claim 8, wherein a second support flange is positioned in the upper portion of the body section.

10. The golf club head of claim 7, wherein the support flange is parallel to the longitudinal axis of the weight receiving feature to counter act loads and moment caused by the mass of the weight member.

11. A golf club head comprising:

a forward section joined to a body section via a tongue-in-grove joint to define an internal volume therebetween;

the body section includes:

a lower portion that defines a sole portion and further comprises a body seam and a body flange;

an upper portion that defines a crown portion and further comprises a first receiving portion configured to mate with the body flange of the lower portion in a clamshell-style arrangement;

a second receiving portion defined by a forward edge and is positioned proximal to the forward section and extends circumferentially around the upper portion and the lower portion of the body section in a direction extending substantially parallel to a strike face;

a support flange extending from the upper portion of the body section and secured to a support flange receiving portion;

the forward section includes:

the strike face adapted to impact a golf ball;

a frame member extending rearwardly from the strike face and a forward flange further extending rearwardly from the frame member;

wherein:

the lower portion and the upper portion of the body section are distinct, single piece structure, thereby defining a first part and a second part, respectively;

the forward section and the body section cooperate to form a three-part golf club head;

the body seam extends around a perimeter of the lower portion and wherein the body flange is disposed along the body seam;

wherein a height of the body flange decreases as a function of an increasing distance from the forward edge;

the first and second receiving portions are a channel-like structure such that the first and second receiving portions extends to the opposing sides of the body flange and the forward flange, respectively;

the first receiving portion of the upper portion is adapted to engage the body flange of the lower portion to become adhesively affixed;

the forward flange of the forward section is configured to be directly inserted into the second receiving portion to become adhesively affixed;

the support flange receiving portion forms a channel that is defined by two uniformly spaced walls positioned such that the two uniformly spaced walls extend on opposing sides of the support flange; and the support flange receiving portion is positioned on the lower portion of the body section.

12. The golf club of claim 11, wherein the forward flange extends from the frame in a uniform direction that is orthogonal to a common reference plane.

13. The golf club of claim 11, wherein the upper portion of the body section is a polymeric material.

14. The golf club of claim 13, wherein the forward section is a metallic material.

15. The golf club of claim 11, wherein the body section further includes a weight receiving feature.

16. The golf club of claim 15, wherein the weight receiving feature is adapted to receive a removable weight member.

17. The golf club of claim 14, wherein the density of the polymeric material is lighter than the density of the metallic material.

18. The golf club head of claim 1, wherein the forward edge of the body section is separated by a distance of from about 15 mm to 40 mm.

19. The golf club head of claim 18, wherein the maximum height of the body flange is between 3.0 mm and 5.0 mm.

20. The golf club head of claim 1, wherein the body flange at the furthest position from the forward edge has a height between 1.5 mm and 3.0 mm.

* * * * *